US011858686B1

(12) United States Patent
Brendlinger

(10) Patent No.: US 11,858,686 B1
(45) Date of Patent: Jan. 2, 2024

(54) PALLET DISPLAY ASSEMBLY

(71) Applicant: John R. Brendlinger, Santa Fe Springs, CA (US)

(72) Inventor: John R. Brendlinger, Santa Fe Springs, CA (US)

( * ) Notice: Subject to any disclaimer, the term of this patent is extended or adjusted under 35 U.S.C. 154(b) by 0 days.

(21) Appl. No.: 17/486,399

(22) Filed: Sep. 27, 2021

Related U.S. Application Data

(63) Continuation of application No. 16/447,598, filed on Jun. 20, 2019, now Pat. No. 11,130,612, which is a continuation of application No. 15/424,645, filed on Feb. 3, 2017, now Pat. No. 10,343,815.

(60) Provisional application No. 62/292,184, filed on Feb. 5, 2016.

(51) Int. Cl.

| | |
|---|---|
| ***B65D 19/38*** | (2006.01) |
| ***B65D 19/00*** | (2006.01) |
| ***B65D 5/52*** | (2006.01) |
| ***B65D 19/16*** | (2006.01) |
| ***B65D 19/20*** | (2006.01) |

(52) U.S. Cl.
CPC ..... *B65D 19/38* (2013.01); *B65D 5/522* (2013.01); *B65D 19/16* (2013.01); *B65D 19/20* (2013.01)

(58) Field of Classification Search
CPC ..... B65D 19/44; B65D 19/02; B65D 19/38; B65D 19/20; B65D 71/0096; B65D 5/522; B65D 5/50; B65D 5/52; B65D 5/12; B65D 19/12; B65D 19/16
USPC ..... 206/45.28, 600, 386; 211/59.4, 72, 211/132.1, 188; 108/56.1, 56.3, 57.16, 108/51.3; 40/617; 229/103.3, 122.24, 229/117.01, 117.05, 117.06, 117.07, 229/117.08, 942, 122.29; 220/617, 4.28, 220/6, 7, 4.31, 4.32
See application file for complete search history.

(56) References Cited

U.S. PATENT DOCUMENTS

| | | | |
|---|---|---|---|
| 1,156,444 | A | 10/1915 | Stevens |
| 2,718,996 | A | 9/1955 | Jamieson |
| 4,883,221 | A | 11/1989 | Brundage |
| 6,267,255 | B1 | 7/2001 | Brush |
| 7,681,735 | B2 | 3/2010 | Youell, Jr. |
| 7,861,865 | B2 | 1/2011 | Green |
| 8,056,727 | B1 | 11/2011 | Marsh |
| 2005/0023168 | A1 | 2/2005 | Marnocha |
| 2005/0236466 | A1 | 10/2005 | McLeod |

*Primary Examiner* — Andrew D Perreault
(74) *Attorney, Agent, or Firm* — Cislo & Thomas, LLP

(57) ABSTRACT

An apparatus for displaying palleted items includes a generally flat main panel under the palleted items, having flaps with the palleted items positioned along fold lines, and with separable side panels configured to engage the flaps at the fold lines. When folded away from the palleted items and engaged together, the side panels securely hide a stack of multiple pallets under the palleted items, and present printed sides for advertising.

20 Claims, 4 Drawing Sheets

PALLET DISPLAY ASSEMBLY

This application is a Continuation of U.S. patent application Ser. No. 16/447,598, entitled "Pallet Display Assembly," filed Jun. 20, 2019, which is a continuation of U.S. patent application Ser. No. 15/424,645, now U.S. Pat. No. 10,343,815, entitled "Pallet Display Assembly," filed 3 Feb. 2017, which claims the benefit of the priority filing date of provisional application No. 62/292,184, filed on Feb. 5, 2016, the contents of which are incorporated by reference herein in their entirety.

BACKGROUND

1. Field of the Invention

The present invention relates generally to specialty packaging, and more particularly to a pallet display capable of assembly around a pallet stack, and disassembly into a more compact arrangement.

2. Description of the Prior Art

Pallets and similar flat standardized transport structures are known in the art and are used for supporting and transporting collections of small to medium-sized mercantile items. Conventional stocking of store shelves requires unpacking items from pallets, refilling the store shelves with new items and removing the pallets. This process is time consuming and inefficient, resulting in added costs which are passed on to consumers. To avoid these costs, warehouse stores and similar bulk item merchants allow customers to select and procure items directly from the pallets they arrive on, avoiding stocking costs and allowing the stores to pass on the savings to the customers. Warehouse stores account for an increasing share of retail sales as a consequence.

While more efficient and cost-saving from a transport, delivery and stocking perspective, offering items directly on pallets has certain disadvantages in terms of marketing and promotion. First, the pallets themselves are frequently unsightly and the items obscured by packaging inserts or, if small, contained in poorly marked boxes on the pallet. Second, pallets are frequently moved or store layouts changed, making it difficult to find a particular item in the warehouse on a return visit. Additionally, when multiple pallets are stacked atop one another to raise items to an easily accessible height, the items are easier to reach but at the aesthetic cost of several unsightly pallets visible to the customer. To overcome these problems various displays to promote items on pallets have been developed.

U.S. Pat. No. 6,152,305 teaches a pallet display assembly wherein items are packaged in structurally resilient display packs stacked vertically in open boxes from which they may be removed. While such an assembly presents the items upright and renders them easily retrievable, the labels are often too small to be seen from a distance and the assembly works only with items suitable for sturdy display packaging such as vacuum-molded plastic packaging.

To avoid those limitations and provide a larger display area, visible from a distance, various apparatus having large side panels have been developed. The side panels can obscure the pallets on which the items are placed and provide a large surface area to display a variety of marketing indicia.

One such panel system is embodied in U.S. Pat. No. 7,861,865 to Green. Green teaches a packaging assembly including four side panels for covering stacked pallets. The side panels each include a mounting flap and a main flap separated by a fold line. The mounting flap is affixed to a pallet using a stapler or similar method such that the fold line matches the edge of the pallet. Items are installed on the pallet and the main panels fold up adjacent the items prior to use, with a lid necessary to secure them in an upright configuration. To form the display, the mounting flaps are folded down and connected together by affixing a side tab on one flap to an adjacent mounting flap with tape or glue.

Green has several disadvantages. Primarily, it requires affixing the mounting flaps to the pallet. This requires special tools, such as an industrial stapler or hammer in the case of conventional pallets, and other, unspecified fixation methods in the case of resin or metal pallets. Additionally, glue or tape is needed to adhere the side tab of one panel to another panel, thus making break down, removal and recycling the display difficult. Green is also not self-aligning, requiring users to ensure the mounting flaps are affixed to the pallet in just the right position to align the side tabs and panels. If not properly aligned, removing, realigning and reinstalling the mounting panels causes unsightly damage to the display.

Accordingly there is need for an improved panel-type pallet display assembly for use with mercantile items sold directly from pallets that is easy to assemble and disassemble and that overcomes the aforementioned disadvantages inherent in the prior art.

SUMMARY

An apparatus for displaying palleted items arranged on a pallet includes a substantially planar main panel for placement under the palleted items, a first flap hingedly, coupled to the main panel along a first fold line, with the palleted items positioned along the first fold line. A second flap is hingedly coupled to the main panel along a second fold line, with the palleted items positioned along the second fold line A first side panel is configured to engage the first flap at the first fold line, and a second side panel is configured to engage the second flap at the second fold line, and the first side panel is configured to engage the second side panel such that when the first side panel and second side panel are folded away from the palleted items and engaged, the first side panel and the second side panel securely hide a predetermined number of pallets under the palleted items.

The apparatus also preferably has a first side panel slot formed along the first fold line between the main panel and the first flap for engaging a first side panel tab, and a second side panel slot formed along the second fold line between the main panel and the second flap for engaging a second side panel tab. The first side panel and the second side panel each comprise a printed side configured to face away from a predetermined number of pallets when the first side panel and the second side panel are folded away from the palleted items.

Preferably, the apparatus includes a locking tab for releasably engaging the first side panel and the second side panel, and the pallet comprises a first top edge in collinear alignment with the first fold line, and a second top edge in collinear arrangement with the second fold line, such that the palleted items are in collinear arrangement with the first fold line and the second fold line. In various alternative embodiments, the first side panel may be shorter in length than the second side panel, the main panel may completely cover the pallet, and the main panel, the first side panel and the second side panel may be made of corrugated cardboard.

The apparatus may also be characterized as an apparatus for displaying palleted items on a pallet, with a substantially planar main panel, a first flap foldably attached to the main panel along a first fold line, a first side panel slot formed along the first fold line between the main panel and the first flap and a first side panel having a first printed side, the first side panel foldably attached to a first side panel tab with the first side panel tab sized for insertion into the first panel slot.

The first side panel preferably has a locking tab configured to engage a second side panel having a second printed side, such that when the first side panel and the second side panel are moved away from the palleted items and held together by the locking tab, the first printed side and the second printed side face away from the pallet. Preferably the main panel also includes a second flap hingedly coupled to the main panel along a second fold line having a second side panel slot, and the locking tab may be configured to engage the second side panel such that when the first side panel and the second side panel are folded toward the palleted items, the first printed side and the second printed side face the palleted items.

In various embodiments the main panel n ay have two opposing first flaps and two opposing second flaps, and the pallet may have a first top edge in collinear alignment with the first fold line, and a second top edge in collinear arrangement with the second fold line. Preferably the first side panel is shorter in length than the second side panel, the main panel completely covers the pallet, the first side panel and the second side panel are sized to hide a predetermined number of stacked pallets, and the main panel, the first side panel and the second side panel are made of corrugated cardboard.

DESCRIPTION

Figure 1:
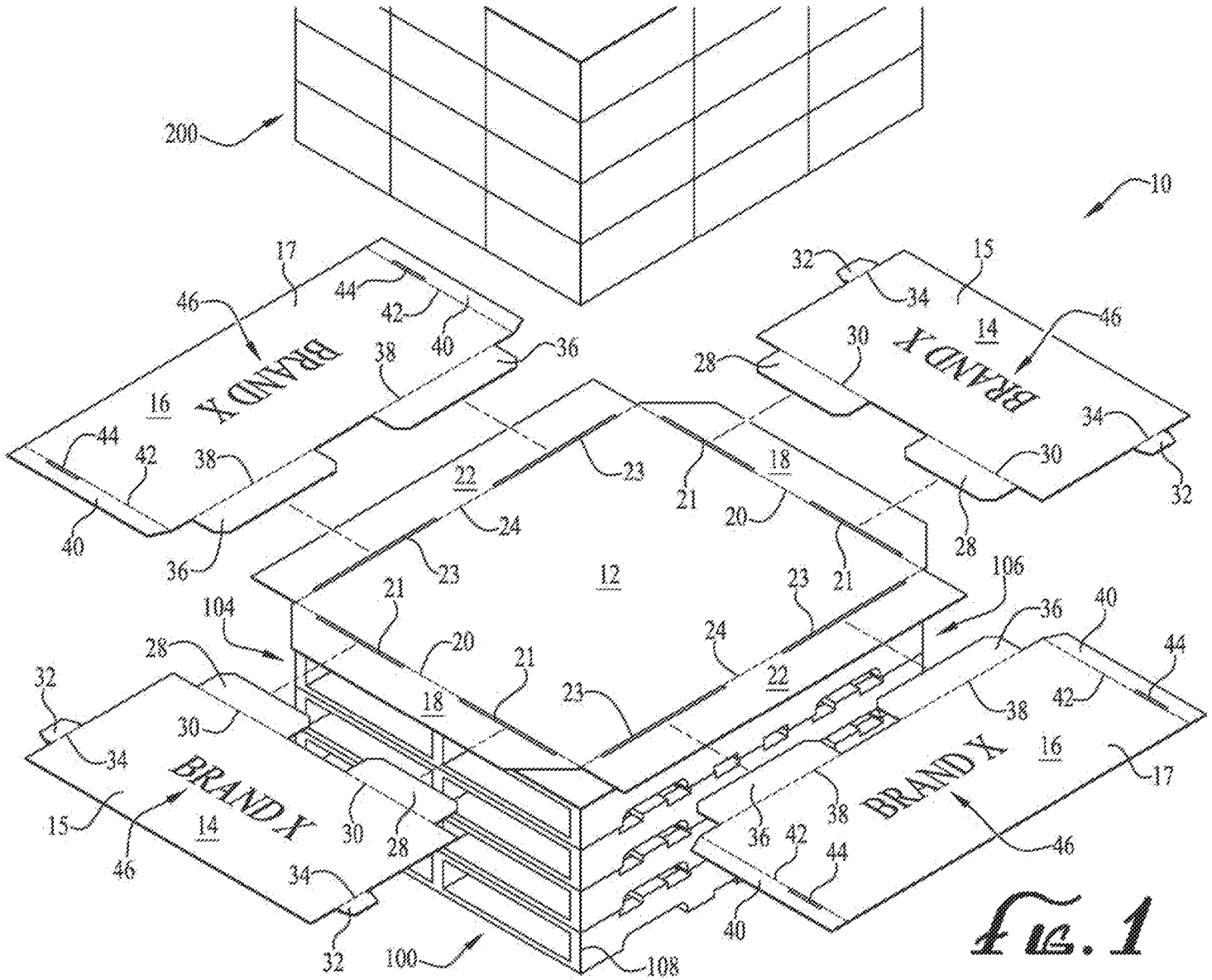
FIG. 1 illustrates an exploded view of a pallet display assembly, including a plurality of pallets and a plurality of assembled items to be displayed on the pallet.

Referring to FIG. 1, a pallet display assembly 10 includes a main panel 12, at least one first or short side panel 14 and at least one second or long side panel 16, all preferably made of corrugated cardboard and corresponding to the standard surface area of commercial pallets 100. The pallets 100 hold and display assembled items 200 to be sold in warehouse store environments. Preferably, two short side panels 14 and two long side panels 16 are used to engage the main panel 12 in order to completely cover the pallets 100. In various embodiments, the short side panels 14 and long side panels 16 may be appropriately sized to cover a predetermined number of stacked pallets 100.

The main panel 12 preferably includes two sets of first or short flaps 18 connected along first or short fold lines 20, and two sets of second or long flaps 22 connected along second or long fold lines 24. The short fold lines 20 and long fold lines 24 correspond to the short top edge 104 and long top edge 106 of the pallets 100, respectively, such that the main panel 12 covers the pallets 100, with the short flaps 18 and long flaps 22 extending over and able to fold down against the pallets 100.

A series of first or short panel slots 21 and second or long panel slots 23 are formed along the short fold lines 20 and long fold lines 24 to align the short side panels 14 and long side panels 16 with the main panel 12. In the illustrated embodiment two short panel slots 21 and two long panel slots 23 are shown along each of the short fold lines 20 and long fold lines 24. In alternative embodiments, other configurations of short panel slots 21 and long panel slots 23 may be positioned according to preference and effectiveness. Preferably, at least one of the short side panels 14 has a first printed side 15, and at least one of the long side panels 16 has a second printed side 17, the first printed side 15 and the second printed side 17 bearing indicia related to the palleted items 200.

Still referring to FIG. 1, each short side panel 14 includes a series of first tabs 28, sized to engage the panel slots 26 along the short fold lines 20. The first tabs 28 are located along first tab fold lines 30 that become collinear with the short fold lines 20 of the main panel 12 when the first tabs 28 are fully inserted into the panel slots 26, thereby allowing the short side panel 14 (along with the short flaps 18) to fold relative to the main panel 12. Each short side panel 14 also includes two locking tabs 32. Each locking tab 32 is located along a locking tab fold line 34. The locking tab fold lines 34 allow each locking tab 32 to engage the long side panels 16 when the short side panels 14 and long side panels 16 are folded down to cover the pallets 100.

Each long side panel 16 includes a series of second tabs 36, sized to engage the panel slots 26 along the long fold lines 24 of the main panel 12. The second tabs 36 are located along second tab fold lines 38 that become collinear with the long fold lines 24 of the main panel 12 when the second tabs 36 are fully inserted into the panel slots 26, thereby allowing the long side panels 16 (along with the long flaps 22) to fold relative to the main panel 12. Each long side panel 16 also includes two corner flaps 40. Each corner flap 40 is connected along a corner flap fold line 42 aligning with a corner 108 of the pallets 100. The corner flaps 40 extend under the short side panels 14 when the pallet display assembly 10 is constructed to create a uniform appearance without the pallets 100 being visible at the corners 108. A locking slot 44 is located along each corner flap fold line 42 for retaining a locking tab 32 when the short side panels 14 and long side panels 16 are folded down over the pallets 100 to retain the pallet display assembly 10 in a displayed position with the first printed side 15 and the second printed side 17 facing outwardly.

The structure of the pallet display assembly 10 having been shown and described, its method of operation will now be discussed.

Figure 2:
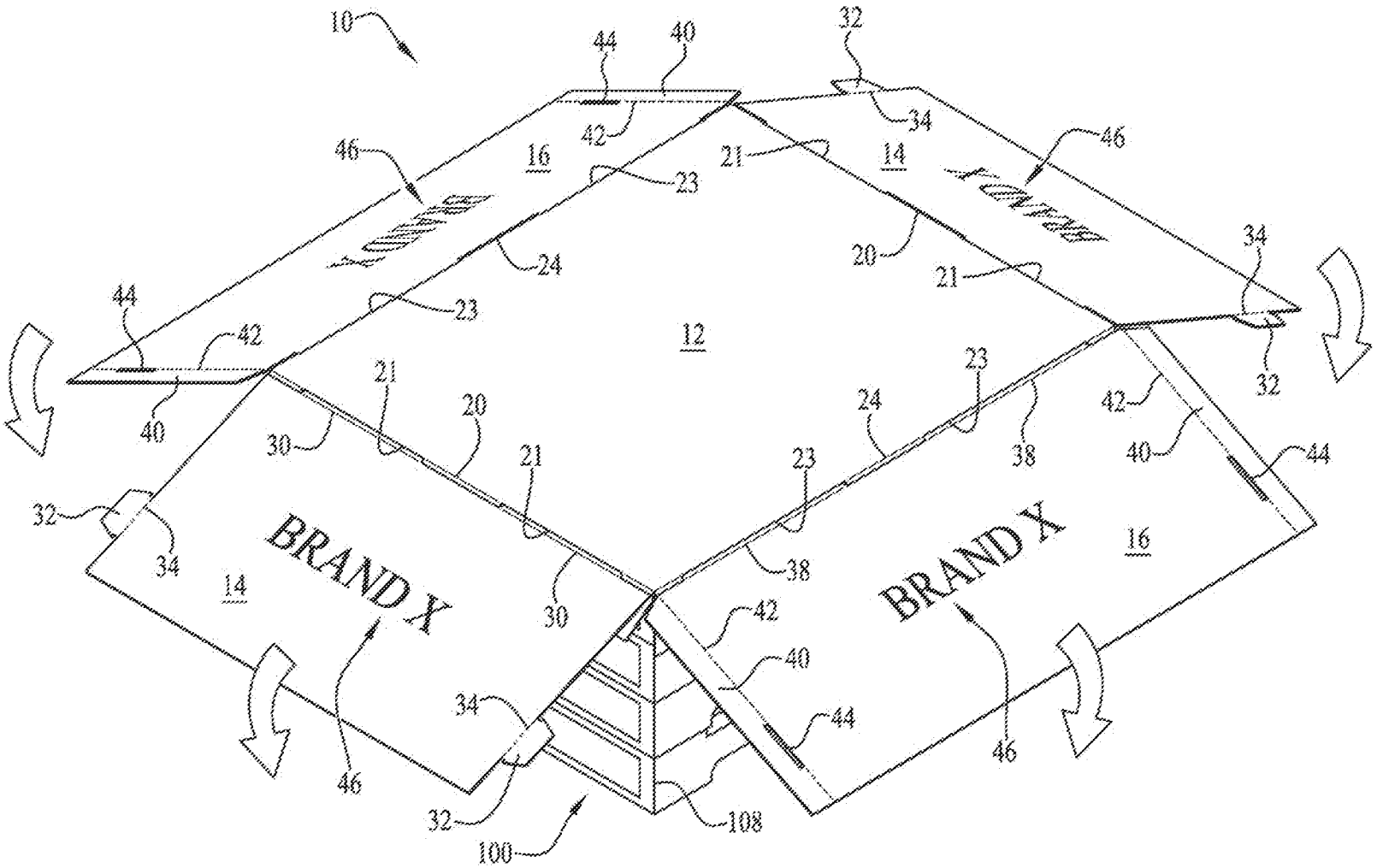
FIG. 2 illustrates the pallet display assembly in a first stage of construction.
Figure 3:
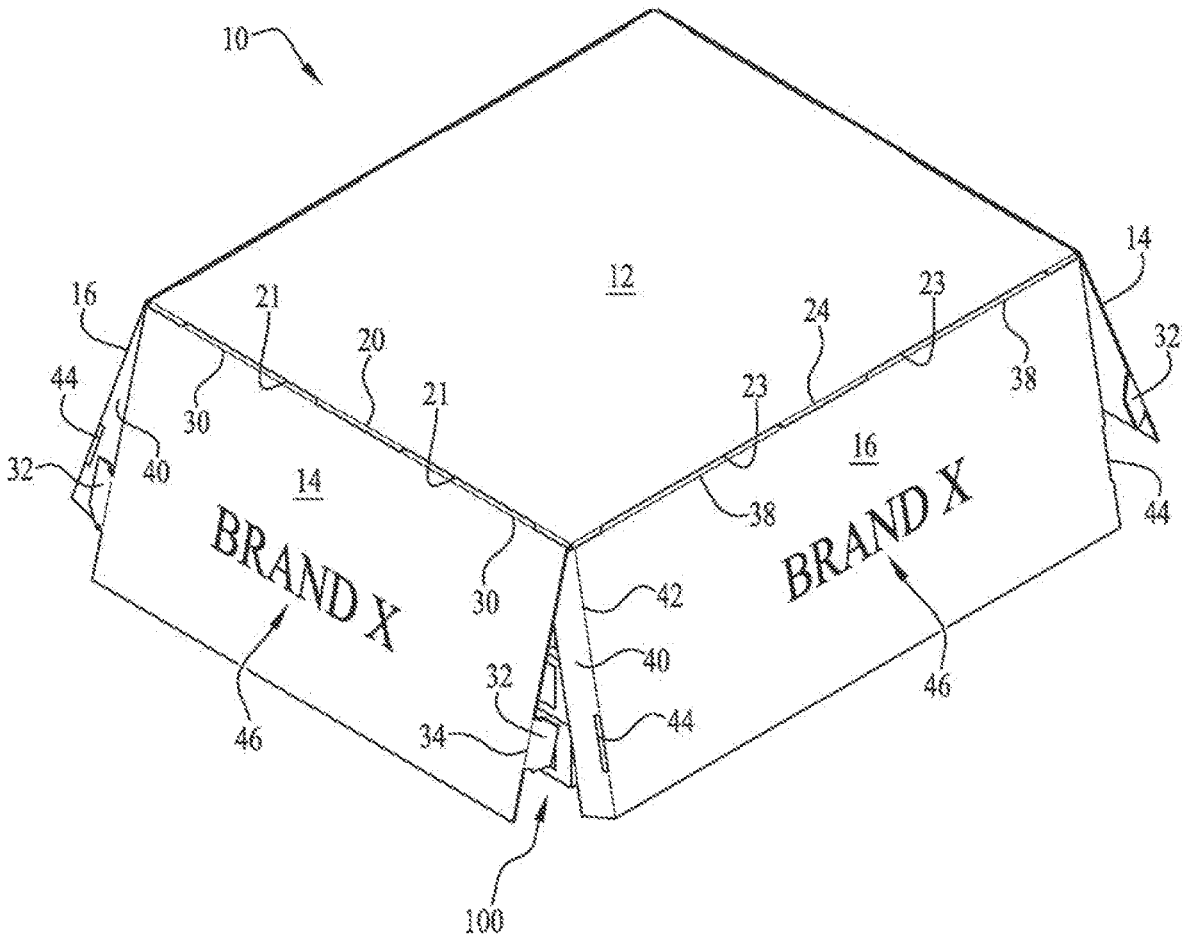
FIG. 3 illustrates the pallet display assembly in a second stage of construction.
Figure 4:
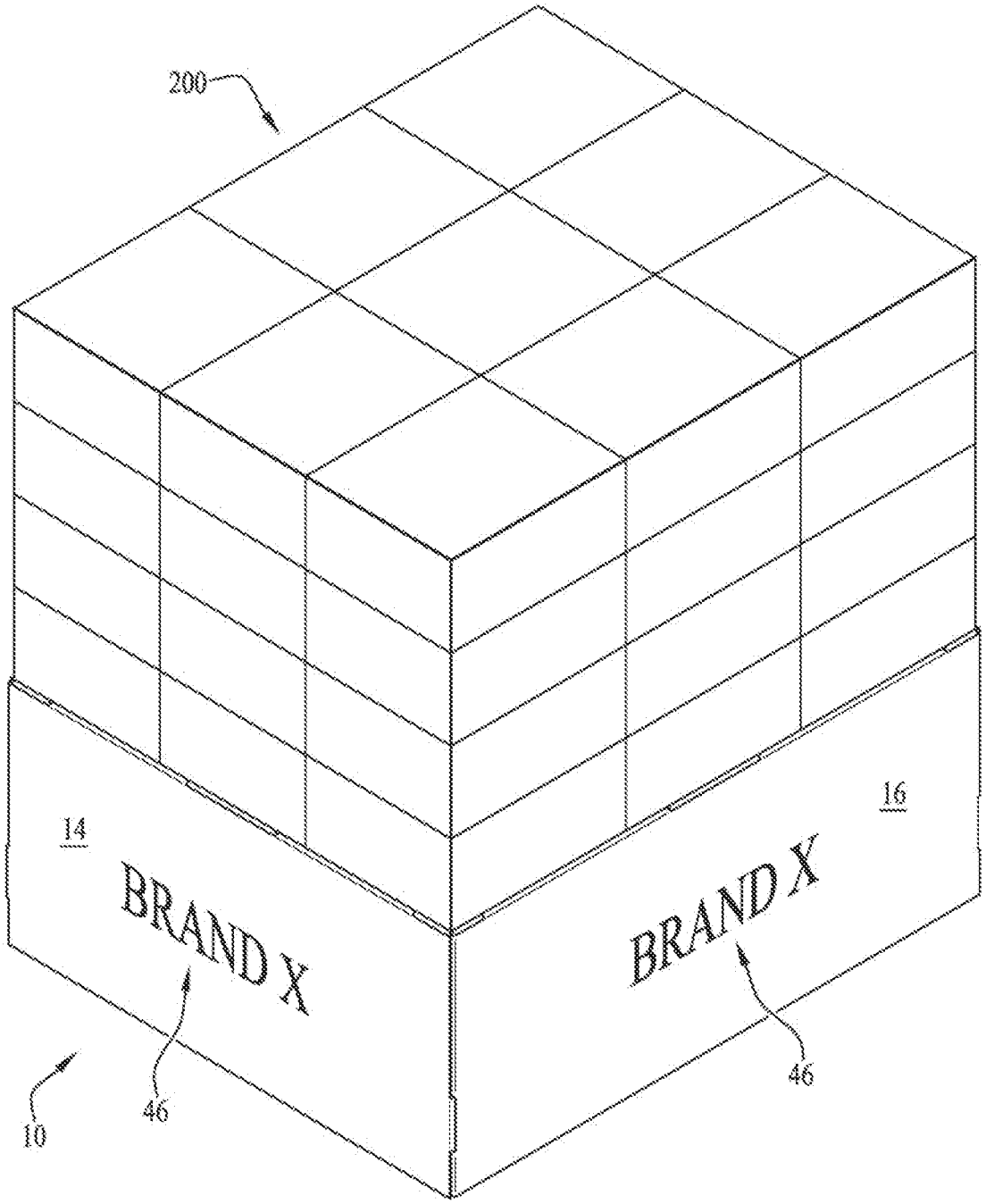
FIG. 4 illustrates the pallet display assembly fully constructed atop the pallets; under the assembled items displayed for sale.

Referring to FIGS. 2-4, in order to install the pallet display assembly 10, the main panel 12 is placed atop the pallets 100 such that the short fold lines 20 and the long fold lines 24 are aligned with the short top edges 104 and the long top edges 106, respectively, of the pallets 100. The short flaps 18 and long flaps 22 extend off the pallets 100 and are folded down along the pallets 100 to make room for the short side panels 14 and long side panels 16. The first tabs 28 and the second tabs 36 are fully inserted into the panel slots 26 such that the first tab fold lines 30 are substantially collinear with the short fold lines 20 and the second tab fold lines 38 are substantially collinear with the long fold lines 24. With the first tabs 28 and second tabs 36 fully inserted into the main panel 12, the short side panel 14 and the long side panel 16 can be folded down to cover the pallets 100.

Still referring to FIGS. 2-4, as the short side panels 14 and the long side panels 16 approach the pallets 100, the corner flaps 40 of the long side panels 16 are folded along each corner flap fold line 42 and inserted under each short side panel 14. The short flaps 18 and the corner flaps 40 may be slanted in profile as illustrated to avoid overlapping when covered by the short side panel 14. As each corner flap 40 travels under a short side panel 14, the locking tabs 32 come within range of the locking slots 44. When the long side panels 16 are folded against the pallets 100, two locking tabs 32 on either side of each short side panel 14 are inserted into the locking slots 44 on either side of each long side panel 16 to lock both the long side panels 16 and the short side panels 14 against the pallets 100.

During installation, at any time after the main panel 12 is placed in position atop the pallets 100 with the first tabs 28 and the second tabs 36 inserted in their respective panel slots 26, the assembled items 200 can be placed atop the main panel 12. With the pallet display assembly 10 covering the pallets 100, customers can view promotions 46 for the assembled items 200 on the short side panel 14 and on the long side panel 16, and at their election, remove one or more of the assembled items 200 for purchase. Once the assembled items 200 are all removed, the pallet display assembly 10 can be easily and conveniently disassembled by disengaging the locking tabs 32 from the locking slots 44, removing the first tabs 28 from the panel slots 26 by pulling each short side panel 14 away from the main panel 12, removing the second tabs 36 from the panel slots 26 by pulling each long side panel 16 away from the main panel 12, and removing the main panel 12 from atop the pallets 100. None of the short side panels 14, long side panels 16, or main panel 12 are affixed to the pallets 100, thereby allowing easy disassembly. Since they lay flat when disassembled, they can also be conveniently stacked, and because no glue or tape is used they can be easily recycled.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A pallet display assembly for displaying palleted items arranged upon a pallet, comprising:

a main panel forming a substantially planar upper surface for placement of the palleted items thereon, the main panel having a plurality of flaps each extending peripherally outward from the upper surface along a fold line for hinged displacement therealong when aligned with one of the top edges of the pallet, the main panel having a panel slot formed along each of the fold lines; and, a plurality of side panels each detachably coupled to one of the flaps of the main panel, each side panel including a panel tab separably engaging one of the panel slots by passing therethrough underneath and parallel to the upper surface of the main panel, and perpendicular to their respective flaps when coupled;

wherein a first of the side panels separably engages a second of the side panels in releasably locked manner when the first of the side panels and the second of the side panels are folded away from the upper surface of the main panel.

2. The pallet display assembly of claim 1, wherein the first and second side panels are configured to extend along and hidingly cover respective sides of a predetermined number of pallets stacked under the palleted items.

3. The pallet display assembly of claim 1, wherein each of the side panels includes a covering surface, the panel tab of each side panel being hingedly coupled to the covering surface thereof along a tab fold line.

4. The pallet display assembly of claim 1, wherein each of the side panels includes a covering surface, and the covering surface of at least one of the side panels defines a printed side facing away from the pallet when the side panels are folded away from the palleted items.

5. The pallet display assembly of claim 1, wherein each of the side panels includes a covering surface, and the first side panel includes a locking tab hingedly coupled to the covering surface thereof along a locking tab fold line, the locking tab releasably engaging the second side panel.

6. The pallet display assembly of claim 5, wherein the second side panel includes a corner flap hingedly coupled to the covering surface thereof along a corner flap fold line, the corner flap having a locking slot formed along the corner flap fold line for releasable engagement by the locking tab of the first side panel.

7. The pallet display assembly of claim 6, wherein the first and second side panels are of unequal lengths.

8. The pallet display assembly of claim 1, wherein each of the main and side panels is integrally formed of a corrugated cardboard material.

9. A pallet display apparatus for displaying palleted items arranged thereon, comprising:

a main panel forming a substantially planar upper surface for placement of the palleted items thereon, the main panel having a plurality of flaps each extending peripherally outward from the upper surface along a fold line for hinged displacement therealong, the main panel having a panel slot formed along each of the fold lines; and, at least one first side panel and at least one second side panel, each of the first and second side panels being detachably coupled to a corresponding one of the flaps of the main panel, each of the first and second side panels including a covering surface and a panel tab extending therefrom to separably engage one of the panel slots by passing therethrough and extending underneath and parallel to the upper surface of the main panel and perpendicular to their respective flaps when assembled;

wherein the first and second side panels are separably engaged in releasably locked manner when folded away from the upper surface of the main panel.

10. The pallet display apparatus of claim 9, wherein the first and second side panels are configured to extend along and hidingly cover respective sides of a plurality of pallets stacked under the palleted items.

11. The pallet display apparatus of claim 9, wherein the panel tab of each of the first and second side panels is hingedly coupled to the covering surface thereof along a tab fold line.

12. The pallet display apparatus of claim 11, wherein the covering surface of at least one of the first and second side panels defines a printed side facing away from the pallet when the side panels are folded away from the palleted items.

13. The pallet display apparatus of claim 11, wherein:

the first side panel includes a locking tab hingedly coupled to the covering surface thereof along a locking tab fold line;

the second side panel includes a corner flap hingedly coupled to the covering surface thereof along a corner flap fold line, the corner flap having a locking slot formed along the corner flap fold line; and, the locking tab releasably engaging the locking slot when the first and second side panels are folded away from the upper surface of the main panel.

14. The pallet display apparatus of claim 9, wherein the first and second side panels are of unequal lengths.

15. The pallet display apparatus of claim 9, wherein each of the main and side panels is integrally formed of a corrugated cardboard material.

16. A display apparatus for displaying items arranged on a pallet, the display apparatus comprising:

a main panel forming a substantially planar upper surface for placement of the palleted items thereon, the main panel having a plurality of flaps each extending peripherally outward from the upper surface along a fold line for foldable displacement therealong, the main panel having a panel slot formed along each of the fold lines; and, a plurality of first side panels and a plurality of second side panels, the first side panels being detachably coupled respectively to a first pair of flaps disposed at mutually opposed sides of the main panel upper surface, the second side panels being detachably coupled respectively to a second pair of flaps disposed at mutually opposed sides of the main panel upper surface, each of the first and second side panels including a covering surface and a panel tab extending therefrom to separably engage one of the panel slots by passing therethrough and extending underneath and parallel to the upper surface of the main panel when assembled;

wherein the first and second side panels are separably engaged in releasably locked manner when folded away from the upper surface of the main panel.

17. The pallet display apparatus of claim 16, wherein the first and second side panels are configured to extend downward from the upper surface of the main panel for hidingly covering respective sides of a plurality of pallets stacked under the palleted items.

18. The pallet display apparatus of claim 16, wherein the panel tab of each of the first and second side panels is hingedly coupled to the covering surface thereof along a tab fold line.

19. The pallet display apparatus of claim 18, wherein:

each of the first side panels includes a plurality of locking tabs hingedly coupled to the covering surface thereof along respective locking tab fold lines;

each of the second side panels includes a plurality of corner flaps hingedly coupled to the covering surface thereof along respective corner flap fold lines, the corner flaps each having a locking slot formed along the corner flap fold line thereof; and, each of the locking tabs releasably engaging one of the locking slots when the first and second side panels are folded away from the upper surface of the main panel.

20. The pallet display apparatus of claim 18, wherein the covering surface of at least one of the side panels defines a printed side facing away from the pallet when the side panels are folded away from the palleted items.

* * * * *